US005208420A

United States Patent [19]

Hamilton et al.

[11] Patent Number: 5,208,420

[45] Date of Patent: May 4, 1993

[54] PROPELLANT STRIP ASSEMBLY

[76] Inventors: Brian K. Hamilton, 6919 S. Steele St., Littleton, Colo. 80122; F. William Pugh, 11610 Thistlehill Dr., Loveland, Ohio 45140

[21] Appl. No.: 939,831

[22] Filed: Sep. 2, 1992

Related U.S. Application Data

[63] Continuation of Ser. No. 851,174, Mar. 13, 1992, abandoned.

[51] Int. Cl.[5] ..... C06C 7/02; F42B 39/08; B25C 1/08

[52] U.S. Cl. ..... 102/281; 102/531; 227/9; 89/33.14

[58] Field of Search ..... 102/531, 281; 89/33.14; 227/8, 9, 10

[56] References Cited

U.S. PATENT DOCUMENTS

| | | | |
|---|---|---|---|
| 573,897 | 12/1896 | Mohr . | |
| 1,704,231 | 3/1929 | Wedger | 102/531 |
| 2,514,401 | 7/1950 | Litjegren | 102/428 |
| 3,318,245 | 5/1967 | Ferri et al. | 102/531 |
| 3,349,710 | 10/1967 | Sposimo | 102/531 |
| 3,372,643 | 3/1968 | Kvavle | 102/531 |
| 3,499,590 | 3/1970 | Bayer et al. | 227/10 |
| 3,529,548 | 9/1970 | Gawlick et al. | 102/531 |
| 3,552,625 | 1/1971 | Udert | 227/10 |
| 3,554,425 | 1/1971 | Oesterle | 227/10 |
| 3,611,870 | 10/1971 | Udert et al. | 102/530 |
| 3,625,153 | 12/1971 | Gawlick et al. | 102/531 |
| 3,625,154 | 12/1971 | Gawlick et al. | 89/33.14 |
| 3,828,676 | 8/1974 | Junker | 102/530 |
| 3,911,825 | 10/1975 | Gawlick et al. | 102/531 |
| 3,923,226 | 12/1975 | Maier | 227/8 |
| 4,056,062 | 11/1977 | Walser et al. | 102/281 |
| 4,063,672 | 12/1977 | Jochum | 227/10 |
| 4,066,198 | 1/1978 | Jochum et al. | 227/8 |
| 4,066,199 | 1/1978 | Jochum et al. | 227/10 |
| 4,114,792 | 9/1978 | Pomeroy | 227/8 |
| 4,138,788 | 2/1979 | Jochum | 42/1 |
| 4,294,173 | 10/1981 | Ferri | 102/281 |
| 4,368,588 | 1/1983 | Jochum et al. | 42/1 |
| 4,406,079 | 9/1983 | Buechel et al. | 42/49 |
| 4,410,124 | 10/1983 | Buechel | 227/9 |
| 4,560,061 | 12/1985 | Haytayan | 206/3 |
| 4,577,793 | 3/1986 | Jochum | 227/10 |
| 4,598,851 | 7/1986 | Kopf | 227/9 |
| 4,611,738 | 9/1986 | Jochum | 227/9 |
| 4,655,380 | 4/1987 | Haytayan | 227/9 |
| 4,687,126 | 8/1987 | Brosius et al. | 227/10 |
| 4,804,127 | 2/1989 | Kirkman | 227/10 |
| 4,819,562 | 4/1989 | Bowman | 102/281 |
| 4,821,938 | 4/1989 | Haytayan | 227/10 |
| 4,830,254 | 5/1989 | Hsu | 227/10 |
| 4,858,811 | 8/1989 | Brosius | 227/10 |

*Primary Examiner*—David H. Brown

[57] ABSTRACT

A propellant strip assembly for use in propellant actuated fastener driving tools. The assembly includes a carrying strip which contains a plurality of pockets which each hold a propellant charge and a sensitizer to activate the charge. The carrying strip is adhesively joined to a cover strip to isolate the individual charges, and each pocket is also sealed around its periphery to further improve the isolation. The cover strip may contain a ribbed section to physically separate the charge and sensitizer within each pocket to aid in prevention of accidental ignition.

17 Claims, 4 Drawing Sheets

PROPELLANT STRIP ASSEMBLY

This application is a continuation of application Ser. No. 07/851,174, filed Mar. 13, 1992, now abandoned.

BACKGROUND OF THE INVENTION

1. Field of the Invention

The present invention is directed to a strip of cartridges for use in a powder actuated fastener driving device, and in particular, to a novel flexible strip which carries a plurality of propellant charges which are used to power a fastener driving tool.

2. Description of the Prior Art

Powder or propellant actuated fastener driving tools are used most frequently for driving fasteners into hard surfaces such as concrete. The most common types of this tool are traditionally single fastener, single shot devices; that is, a single fastener is manually inserted into the firing chamber of the tool, along with a single propellant charge. After the fastener is discharged, the tool must be manually reloaded with both a fastener and propellant charge in order to be operated again. Examples of this tool are shown in U.S. Pat. Nos. 4,830,254; 4,598,851; and 4,577,793.

In these types of tools, there are many different types of cartridges used for propellants. For example, U.S. Pat. No. 3,372,643 teaches a low explosive primerless charge consisting of a substantially resilient fibrous nitrocelluose pellet with an igniter portion with a web thickness less than any other dimension of the pellet. U.S. Pat. No. 3,529,548 is directed to a powder cartridge consisting of a cartridge case constructed of two separate pieces which contains a central primer receiving chamber and an annular propellant receiving chamber. U.S. Pat. No. 3,911,825 discloses a caseless propellant charge having an H-shaped cross section composed of a primer igniter charge surrounded by an annular propellant powder charge.

A second type of powder actuated tool has also been used in recent times. This tool still uses fasteners which are individually loaded into the firing chamber of the devices; however, the propellant charges used to provide the energy needed to drive the fasteners are provided on a flexible band of serially arranged cartridges which are fed one-by-one into the combustion chamber of the tool. Examples of these type of tool are taught in U.S. Pat. Nos. 4,687,126; 4,655,380; and 4,804,127.

In the tools heretofore mentioned which use a cartridge strip assembly, there are a variety of strips which are available for use with such tools. U.S. Pat. No. 3,611,870 is directed to a plastic strip in which a series of explosive charges are located in recesses in the strip with a press fit. U.S. Pat. No. 3,625,153 teaches a cartridge strip for use with a powder actuated tool which is windable into a roll about an axis which is substantially parallel to the surface portion of the strip and having the propellant cartridges disposed substantially perpendicular to the surface portion. U.S. Pat. No. 3,625,154 teaches a flexible cartridge strip with recesses for holding propellent charges wherein the thickness of the strip corresponds to the length of the charge contained therein. U.S. Pat. No. 4,056,062 discloses a strip for carrying a careless charge wherein the charge is held in the space by a recess and a tower-shaped wall and is disposed in surface contact with the annular service within the cartridge recess. U.S. Pat. No. 4,819,562 describes a propellant containing device which has a plurality of hollow members closed at one end and a plurality of closure means each having a peripheral rim which fits into the open end of the hollow members of the device.

Recently, several powder actuated tools have been developed which operate in a manner similar to the traditional pneumatic tools; that is, these devices contain a magazine which automatically feeds a plurality of fasteners serially to the drive chamber of the tool, while a strip of propellant charges is supplied serially to the tool to drive the fasteners.

One example of this tool is taught in U.S. Pat. No. 4,821,938. This patent, which teaches an improved version of a tool taught in U.S. Pat. No. 4,655,380, is directed to a powder actuated tool with an improved safety interlock which permits a cartridge to be fired only when a safety rod is forced into the barrel and cylinder assembly and when the barrel and cylinder assembly has been forced rearwardly into its rearward position.

Another example of this type of tool is taught in U.S. Pat. No. 4,858,811. This tool, which is an improved version of the tool taught in U.S. Pat. No. 4,687,126, incorporates a handle, a tubular chamber, a piston, and a combustion chamber within the tubular chamber, the combustion chamber receiving a cartridge in preparation for firing, which upon ignition, propels the piston forwardly for the driving of a nail, a fastener housing located forwardly of the tubular chamber, and provided for shifting a strip of fasteners held by a magazine upwardly through the tool during repeated tool usage.

Consequently, a need exists for a single propellant strip assembly that can be efficiently used in connection with fastener driving tools which have been designed as a replacement for traditional pneumatic tools.

It is thus an object of the present invention to overcome the disadvantages of the above described prior art by the use of a propellant strip assembly in which the propellant charge and sensitizer charge are contained between a flexible carrier strip and a cover strip which is sealed tightly around each individual charge to isolate the charges.

It is also an object of the present invention to provide a propellant strip assembly in which the propellant charge and the sensitizer are physically separated within each chamber to lessen the chance for inadvertant ignition.

It is further an object of the present invention provide a flexible but sturdy propellant strip assembly which can be rolled into a coil for safe and efficient handling.

SUMMARY OF THE INVENTION

These and other objects are accomplished by a propellant strip assembly which seals a charge assembly and a sensitizing agent within each chamber or pocket of a flexible carrier strip. The sealing is accomplished by the use of a second flexible strip which is adhesively joined to the carrier strip to isolate each charge assembly. The pockets of the carrier strip are further isolated by sealing around the periphery of each pocket by ultrasonic welding or the like. Isolation between the propellant charge and sensitizer within each pocket is accomplished by the use of ribs on the cover strip, which physically separate the two elements.

DESCRIPTION OF THE PREFERRED EMBODIMENTS

Figure 1:
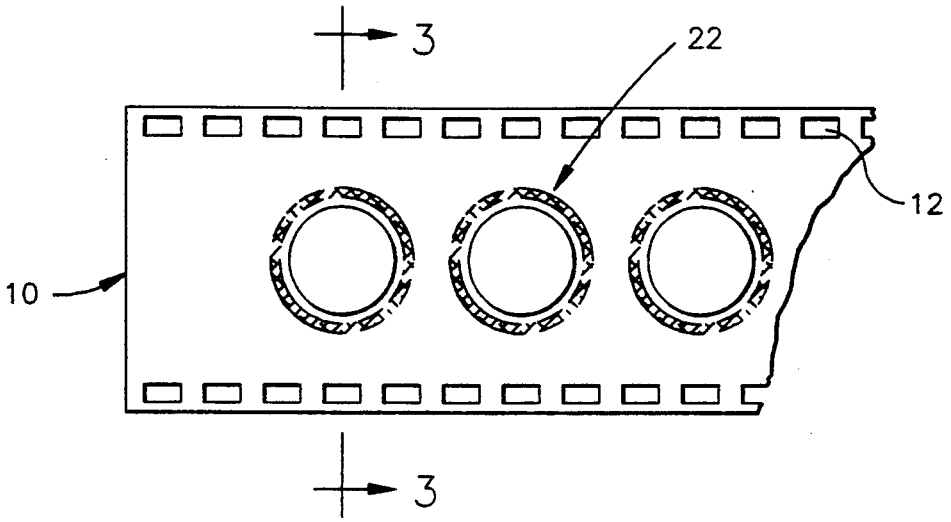
FIG. 1 is a plan view, partly in cross section, of one embodiment of a propellant strip assembly constructed in accordance with the present invention.

Referring now to FIG. 1, there is shown an embodiment of a propellant strip assembly, generally designated at 10, according to the present invention.

Strip 10 is preferably composed of a thin, light flexible material, which is durable and resistant to tearing. A series of apertures or preforations 12 are spaced along each edge of strip 10. Perforations 12 enable strip 10 to be fed into a fastener driving tool by a suitable feeding means.

Figure 3:
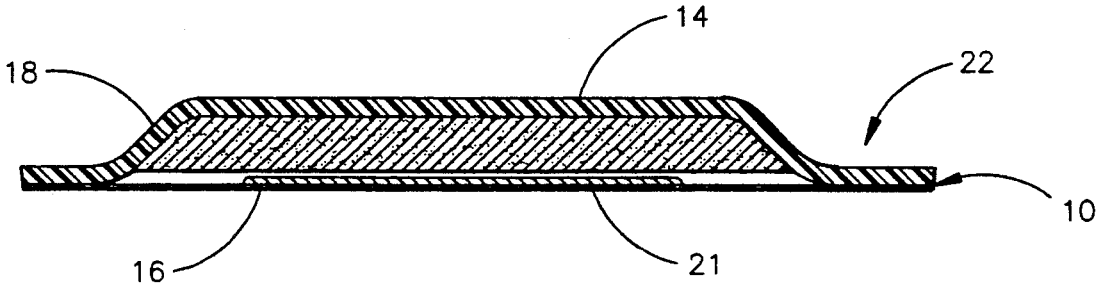
FIG. 3 is an enlarged section taken along lines 3—3 of FIG. 1.

Referring now to FIG. 3, propellant strip assembly 10 is composed of a carrier strip section 14 and a cover strip section 16. Carrier strip 14 contains a plurality of recessed pockets 18 each of which carry a propellant charge 20 which provides the combustion gases necessary to propel the piston of the tool for driving fasteners into a workpiece.

Propellant charge or disk 20 is composed of an explosive substance, preferably a mixture of nitrocellulose and potassium chlorate. In addition, adjacent to each disk 20 within each pocket 18 is a sensitizer 21 to aid in the ignition of disk 20. Sensitizer 21 is composed of a substance, such as red phosphorus, which frictionally reacts with disk 20 to cause the ignition thereof. Carrier strip 14 is preferably composed of a strong, flexible material such as polycarbonate, cellulose acetate, or a treated paper. Cover strip 16 is also preferably composed of a strong, flexible material such as cellophane or treated paper. Strips 14 and 16 may be fastened together by use of an adhesive or the like to form strip assembly 10 with propellant disks 20 inserted into each propellant carrying pocket 18. A welded seal 22 is formed around the circumference of each propellant carrying pocket 18. This seal 22, which is applied to strip 10 by heat, secondary adhesives, ultrasonic welding, or other similar means, has several purposes. Seal 22 serves to protect each propellant disk 20 from moisture which may adversely affect to combustion properties of the disk. In addition, seal 22 also prevents disks 20 from falling out of strip 10 and impedes their intentional removal. Seal 22 also acts to isolate each of the propellant disks 20, affording greater safety from accidental ignition.

Figure 2:
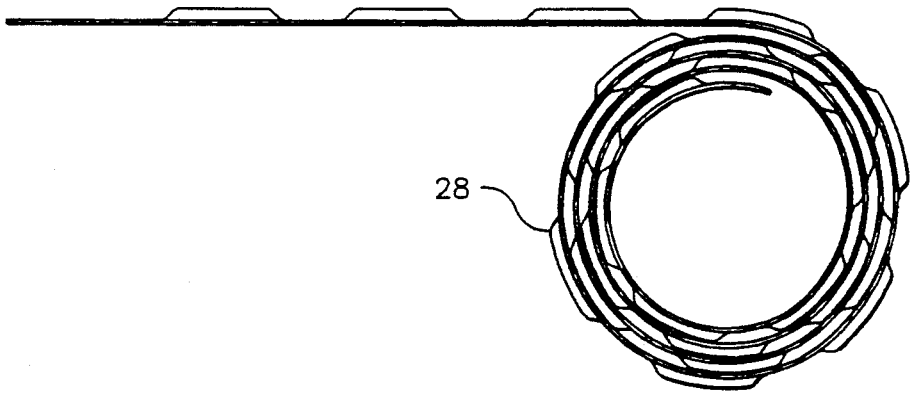
FIG. 2 is an elevational view of the strip assembly of FIG. 1.

The flexible properties of strip 10 enhance its ability to be easily rolled into a coil 28, as is clearly shown in FIG. 2.

Figure 4:
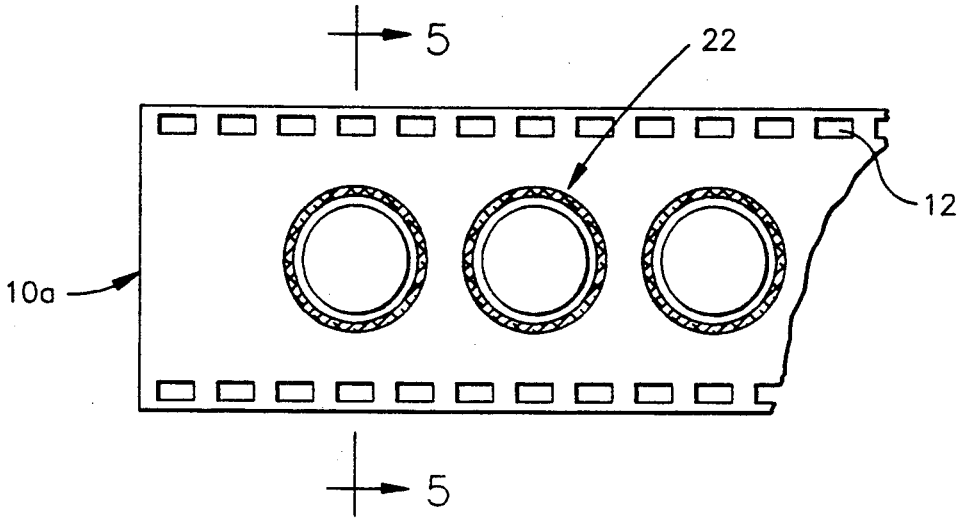
FIG. 4 is a plan view, partly in cross section, of a second embodiment of a propellant strip assembly constructed in accordance with the present invention.
Figure 5:
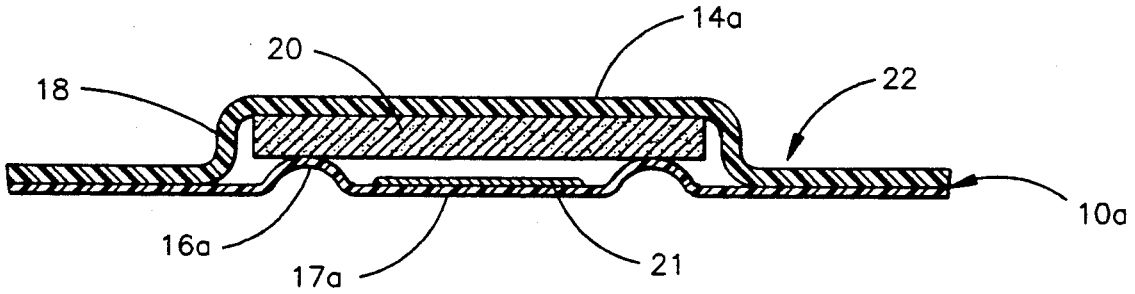
FIG. 5 is an enlarged section taken along lines 5—5 of FIG. 4.

A second embodiment of a propellant strip assembly according to the present invention is shown in FIGS. 4–5.

Propellant strip 10*a*, which is composed of a thin, flexible material, contains a series of feeding means, shown as perforations 12, equally spaced along each side of strip 10*a* to facilitate feeding of the strip within a fastener driving tool. Strip 10*a* is composed of a carrier strip section 14*a* and a cover strip section 16*a*, which sections are fastened together with a suitable adhesive. Carrier strip section 14*a* contains a series of equally spaced pockets 18 into which propellant disks 20 are inserted. Cover strip 16*a* contains a series of ribs 17 which are indented toward carrier strip section 14*a*, as shown in FIG. 5. Ribs 17 are used to space the propellant disk 20 away from the central portion 17*a* of cover strip 16*a*. By using this configuration, sensitizer 21 can be applied to portion 17*a* of strip 16*a*, effectively separating disk 20 from sensitizer 21. This configuration enhances the safety of propellant strip assembly 10*a* by reducing the potential for preignition of propellant disk 20. A welded seal 22 can then be placed around the circumference of each pocket 18.

Figure 6:
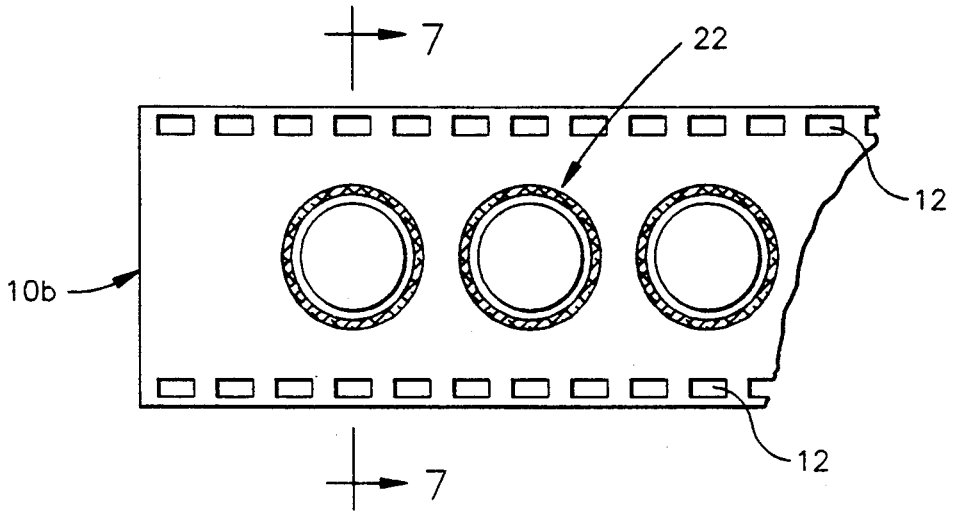
FIG. 6 is a plan view, partly in cross section, of a third embodiment of a propellant strip assembly constructed in accordance with the present invention.
Figure 7:
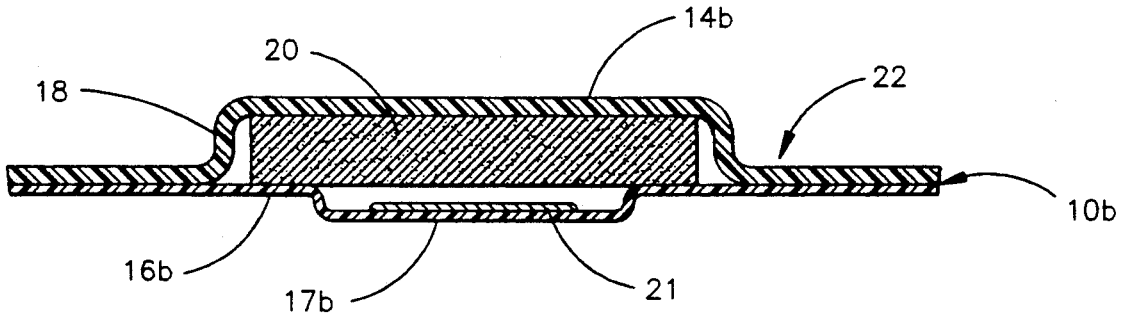
FIG. 7 is an enlarged section taken along lines 7—7 of FIG. 6.

A third embodiment of a propellant strip assembly according to the present invention is shown in FIGS. 6–7.

Propellant strip 10*b*, which is composed of a thin, flexible material, contains a series of feeding means spaced along the edges of strip 10*b* for feeding the strip through a fastener driving tool.

Strip 10*b* is composed of a carrier strip section 14*b* and a cover strip 16*b*, which sections are fastened together by a suitable adhesive. Carrier strip section 14*b* contains a series of equally spaced pockets 18 into which propellant disks 20 are inserted. Cover strip section 16*b* contains a series of circumferential recesses 17*b* which are recessed away from carrier strip 14*b*, as shown in FIG. 7. Recess 17*b* allows sensitizer 21 to remain spaced apart from the propellant disk 20 to reduce the potential for preignition. Sensitizer 21 can be applied to the inside part of recess 17*b*, effectively separating disk 20 from sensitizer 21. A welded seal can then be placed around the circumference of each pocket 18.

Figure 8:
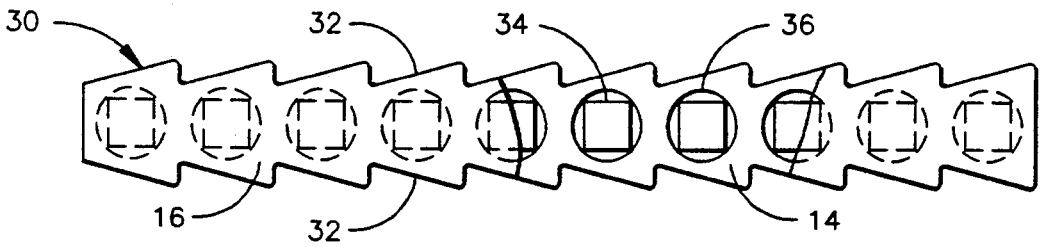
FIGS. 8–12 are plan views of different embodiments of propellant strip assemblies constructed in accordance with the present invention.
Figure 9:
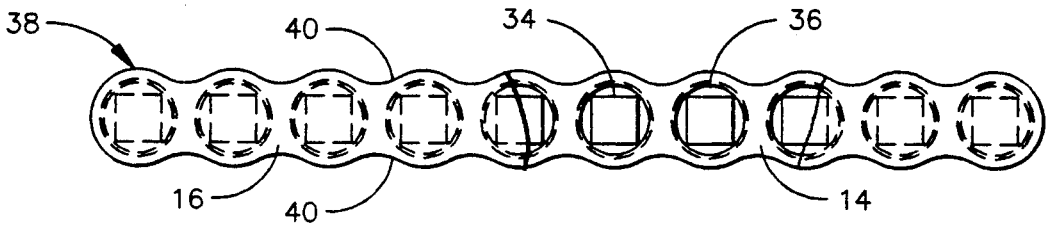
Figure 10:
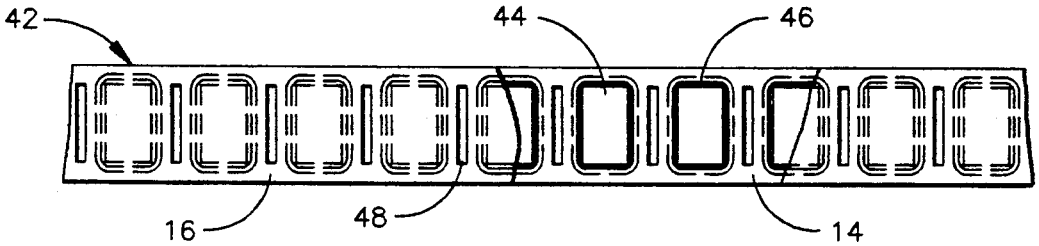
Figure 11:
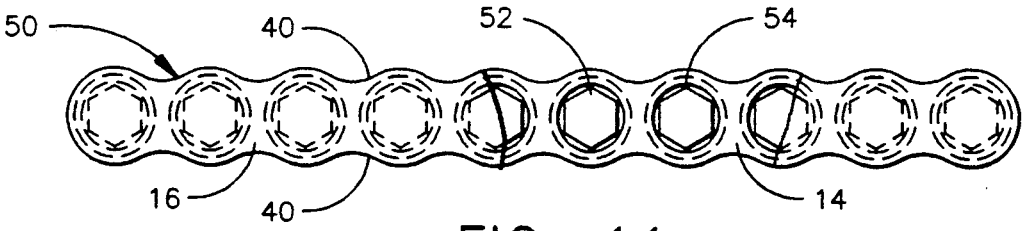
Figure 12:
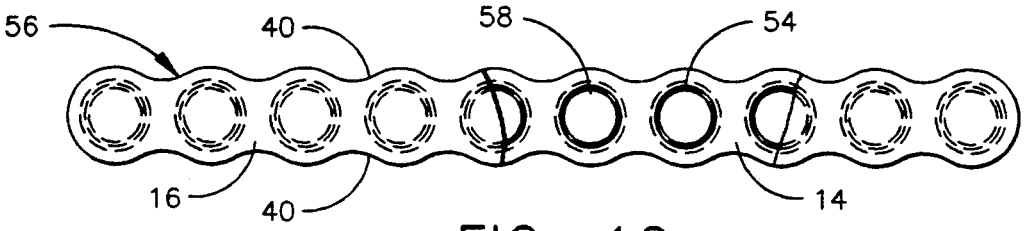

FIGS. 8–12 illustrate other configurations which may be used to embody the propellant strip assembly of the present invention. FIG. 8 shows a propellant strip assembly 30 which contains a sawtooth edge 32 on each side of the strip to enable strip 30 to be fed within the fastener driving tool. Propellant charges 34 are of a square configuration suitable to be contained within the recessed pockets 36 of strip 30. FIG. 9 shows a propellant strip assembly 38 similar to that shown in FIG. 8, but which contains a curved feeding surface 40 on either side of strip 38. FIG. 10 shows a propellant strip assembly 42 carrying propellant charges 44 of a rectangular shape suitable to be contained within the recessed pockets 46 of strip 42. Perforations 48 are located between pockets 46 in the central region of strip 42 to enable the feeding of strip 42 within a fastener driving tool. FIG. 11 shows a propellant strip assembly 50 similar to that shown in FIG. 13, except that propellant charges 52 are of a hexagonal shape which nicely fit into the recessed pockets 54 of strip 50. Finally, FIG. 12 shows a propellant strip assembly 56 similar to that of FIG. 9, except that propellant charges 58 are circular in shape.

While this invention has been shown and described in terms of several preferred embodiments thereof, it will be understood that this invention is not limited to these particular embodiments and that any changes and modifications may be made without departing from the true spirit and scope of the invention as defined in the appended claims.

What is claimed is:

1. A propellant strip assembly for use with a fastener driving tool comprising:

a plurality of propellant charges;

a plurality of sensitizers associated with each propellant charge for activating said charge;

a flexible carrying strip containing a plurality of chambers for holding each charge;

a flexible cover strip for holding each propellant charge and sensitizer within a chamber of said carrying strip;

and means associated with one of said strips for feeding said strip assembly into said fastener driving tool.

2. The strip assembly of claim 1, wherein each propellant charges comprises a mixture of nitrocellulose and potassium chlorate.

3. The strip assembly of claim 1, wherein each sensitizer comprises red phosphorus.

4. The strip assembly of claim 1, wherein said feed means comprises a plurality of apertures uniformly spaced along each edge of said carrying strip.

5. The strip assembly of claim 1 wherein said feed means comprises plurality of triangular surfaces correspondingly positioned along each edge of said carrying strip.

6. The strip assembly of claim 1, wherein said carrying strip is made from a polycarbonate material.

7. The strip assembly of claim 1, wherein said cover strip is made from paper.

8. The strip assembly of claim 1, wherein the shape of said chambers is circular and the shape of said propellant charges is circular.

9. The strip assembly of claim 1, wherein the shape of said chambers is circular and the shape of said propellant charges is rectangular.

10. The strip assembly of claim 1, wherein said feed means comprises a plurality of apertures uniformly spaced and located between said chambers of said carrying strip.

11. The strip assembly of claim 1, wherein said carrying strip and said cover strip are held together by adhesive means.

12. The strip assembly of claim 1, further comprising sealing means associated with each chamber in order to isolate each propellant charge.

13. The strip assembly of claim 12, wherein said sealing means consists of an ultrasonic weld around the periphery of each chamber.

14. The strip assembly of claim 1, wherein said cover strip contains means for separating said sensitizer from said propellant charge.

15. The strip assembly of claim 14, wherein said separating means comprises a plurality of ribs arranged such that said sensitizer is attached to said cover strip within said ribs, and said ribs position said propellant charge out of contact with said sensitizer within each chamber of said carrying strip.

16. The strip assembly of claim 14, wherein said separating means comprises a recess having a smaller width than that of said chamber of said carrying strip, such that said sensitizer is attached to said cover strip within said recess and remains out of contact with said propellant charge within each chamber.

17. A propellant strip assembly, comprising:

a plurality of propellant charges;

a plurality of sensitizers associated with each propellant charge for activating said charge;

a flexible carrying strip containing a plurality of chambers for holding each charge; and a flexible cover strip for holding each propellant charge and sensitizer within a chamber of said carrying strip, wherein said cover strip contains means for physically separating said sensitizer from said propellant charge within each chamber.

* * * * *